US006203275B1

(12) United States Patent
Kobayashi et al.

(10) Patent No.: US 6,203,275 B1
(45) Date of Patent: Mar. 20, 2001

(54) CENTRIFUGAL COMPRESSOR AND DIFFUSER FOR CENTRIFUGAL COMPRESSOR

(75) Inventors: Hiromi Kobayashi; Hideo Nishida; Kazuki Takahashi, all of Ibaraki-ken; Takashi Eino, Tsuchiura, all of (JP)

(73) Assignee: Hitachi, LTD, Tokyo (JP)

( * ) Notice: Subject to any disclaimer, the term of this patent is extended or adjusted under 35 U.S.C. 154(b) by 0 days.

(21) Appl. No.: 09/142,013

(22) PCT Filed: Mar. 6, 1996

(86) PCT No.: PCT/JP96/00541

§ 371 Date: Aug. 31, 1998

§ 102(e) Date: Aug. 31, 1998

(87) PCT Pub. No.: WO97/33092

PCT Pub. Date: Sep. 12, 1997

(51) Int. Cl.[7] ..... F04D 29/44

(52) U.S. Cl. ..... 415/199.2; 415/208.4; 415/224.5

(58) Field of Search ..... 415/199.1, 199.2, 415/199.3, 208.3, 208.4, 224.5

(56) References Cited

U.S. PATENT DOCUMENTS

| | | | | |
|---|---|---|---|---|
| 4,421,457 | | 12/1983 | Yoshinaga et al. . | |
| 4,579,509 | * | 4/1986 | Jacobi | 415/199.1 |
| 4,900,225 | * | 2/1990 | Wulf et al. | 415/212.1 |
| 5,062,766 | | 11/1991 | Miura et al. | 415/199.1 |
| 5,316,441 | | 5/1994 | Osborne | 415/208.4 |
| 5,417,547 | * | 5/1995 | Harada | 415/208.4 |

FOREIGN PATENT DOCUMENTS

| | | |
|---|---|---|
| 306749 | 7/1955 | (CH) . |
| 449940 | 9/1927 | (DE) . |
| 1028281 | 4/1958 | (DE) . |
| 2419415 | 10/1979 | (FR) . |
| 53-119411 | 10/1978 | (JP) . |
| 56-97598 | 8/1981 | (JP) . |
| 1-125599 | 5/1989 | (JP) . |
| 5-20597 | 3/1993 | (JP) . |
| 5-33397 | 5/1993 | (JP) . |

* cited by examiner

*Primary Examiner*—Edward K. Look
*Assistant Examiner*—Richard Woo
(74) *Attorney, Agent, or Firm*—Antonelli, Terry, Stout & Kraus, LLP

(57) ABSTRACT

In a multi-stage centrifugal compressor, having a plurality of impellers mounted on a rotation shaft, or a single-stage centrifugal compressor, a vaned diffuser, having a plurality of vanes, is mounted at a downstream side of the impeller, and a vaneless diffuser portion is formed downstream of this vaned diffuser. A meridian plane cross-sectional shape of each of two wall surfaces forming the vaneless diffuser portion provided downstream of the vaned diffuser is such that its channel height is decreased progressively in a downstream direction. Instead of this vaneless diffuser, there can be provided a second vaned diffuser having a small number of vanes. In this case, also, two wall surfaces, forming the second vaned diffuser, are contracted progressively in the downstream direction.

16 Claims, 7 Drawing Sheets

CENTRIFUGAL COMPRESSOR AND DIFFUSER FOR CENTRIFUGAL COMPRESSOR

TECHNICAL FIELD

This invention relates to a centrifugal compressor and a diffuser used therein, and more particularly to a centrifugal compressor and a centrifugal blower for handling a relatively small volume of gas and a diffuser used therein.

BACKGROUND ART

Diffusers for centrifugal compressors are broadly classified into vaneless diffusers and vaned diffusers. Among these, the vaned diffuser changes the direction of flow by vanes, and also decelerates the flow by the vanes, and therefore generally the efficiency in the vicinity of a design flow rate is higher as compared with the vaneless diffusers. However, the efficiency is lowered at the large flow rate and the small flow rate because of an increased loss by the vanes and the stall of the flow by the vanes, so that the range of the operation is narrow.

Therefore, there has been proposed a diffuser with a small chord-pitch ratio (hereinafter referred to as "low solidity vaned diffuser) disclosed in Japanese Patent Unexamined Publication No. 53-119411, in which the operation range is not so narrowed even with the use of a vaned diffuser, and the efficiency can be enhanced to a certain degree.

Japanese Utility Model Unexamined Publication No. 56-97598 discloses an example in which a channel height is abruptly narrowed at a vaneless portion provided downstream of a low solidity vaned diffuser, and the channel length of the vaneless portion is shortened so as to reduce a friction loss. Further, Japanese Patent Unexamined Publication No. 1-125599 discloses an example in which in a compressor stage of a relatively low specific speed, a channel height of a vaned portion of a vaned diffuser is decreased progressively in a downstream direction so as to enhance the efficiency by reducing a friction loss.

DISCLOSURE OF THE INVENTION

In the case of an impeller for a so-called low-specific speed compressor in which the specific speed, determined by a rotational speed, a flow rate and an adiabatic head of a compressor, is not more than about 250 (rpm,$m^3$/min,m), a discharge flow angle of the impeller, that is, a flow angle at an inlet of a diffuser, is small, and an axial height of a flow passage is low. Therefore, when a vaneless diffuser is used as a diffuser, there is encountered a disadvantage that a friction loss increases. On the other hand, when a vaneless diffuser is used in a low specific speed compressor stage, a rotating stall occurs, in many cases, in a vaneless diffuser portion. Therefore, in a multistage compressor in which a working fluid becomes high in pressure, there is encountered a disadvantage that the fluid oscillation due to a rotating stall limits the operation range.

In order to prevent the narrowing of the operation range by this rotating stall, there have been proposed various methods of delaying the occurrence of a rotating stall when a vaneless diffuser is used. In one of these methods, height of flow passage is reduced at an inlet portion of a diffuser (to reduce the passage height at a certain section will hereinafter referred to as "to contract"), thereby shifting the flow rate at the onset point of stall to the low flow rate. However, the diffuser of such a construction is lower in efficiency than a vaned diffuser, and besides the flow passage height of the stationary channel, including the diffuser, is low, and therefore there has been encountered a disadvantage that a wetted perimeter area increases, so that a friction loss increases. And besides, it is difficult to positively prevent the rotating stall even with the use of this diffuser, and the reliability is low.

On the other hand, the efficiency can be enhanced by the use of a high solidity vaned diffuser (vaned diffuser with a large chord-pitch ratio). However, when this type of vaned diffuser is used, the surging occurs in a small flow rate because of stall of vanes themselves, and besides since the choking is caused in a large flow rate area, there is encountered a disadvantage that the operation range is narrowed, and therefore this is not practical.

It is known that a low solidity vaned diffuser with a small chord-pitch ratio is higher in efficiency than a vaneless diffuser, and that a wide operation range can be secured. However, for achieving a larger pressure recovery with this low solidity vaned diffuser, it is necessary to provide a vaneless portion downstream of the low solidity vaned diffuser. In the case of using a low solidity vaned diffuser, the passage height of a vaneless portion, provided downstream of vanes, has heretofore been made equal to the passage height of a vaned portion. The flow can not be sufficiently deflected with the low solidity vaned diffuser. Therefore, if an inlet angle of the fluid into the diffuser is small, a rotating stall may occur in the vaneless portion even when the flow is deflected to a certain degree in the vaned portion of the diffuser, and in this case the operation range is limited.

In the example disclosed in the above Japanese Utility Model Unexamined Publication No. 56-97598, taking it into consideration that the diffuser may be used in a compressor stage of a relatively high specific speed, the passage height is abruptly contracted downstream of the vanes of the diffuser, thereby reducing the axial height of the flow passage. In this known example, however, any consideration is given to the rotating stall, and the enlargement of the operation range of the compressor is not always sufficient. Namely, in this known example, the following two points, which are important for preventing the rotating stall, are not taken into consideration. The first point is the passage height ratio (contraction ratio) between the vaned portion and the vaneless portion. In the example disclosed in Japanese Utility Model Unexamined Publication No. 56-97598, this value is 0.6 to 0.9, but this is not sufficient from the viewpoint of prevention of the rotating stall.

The second point is the instability of the flow due to the unevenness of the flow downstream of the vanes of the diffuser. The flow downstream of the diffuser vane is not uniform in the peripheral direction because of wake of the vane, and particularly in the low specific speed compressor stage, the flow angle (angle measured in the peripheral direction) is small even after the flow passes past the vaned portion. This uneven flow distribution is hard to be made uniform since the flow at the vaneless portion is a decelerated flow. Further, since the gradient of the static pressure is large in the radial direction, the flow becomes unstable. Therefore, if the diffuser is contracted abruptly or discontinuously at this vaneless portion, the static pressure gradient in the radial direction becomes discontinuous, and also the flow is not made uniform in the peripheral direction to become unstable, and this is a reverse effect from the viewpoint of prevention of the rotating stall.

In the low specific speed compressor stage, the inlet angle of the fluid into the diffuser is small, and therefore when the flow is not sufficiently deflected by the vanes of the diffuser, or when the vanes of the diffuser are locally stalled, there is a possibility that this causes a rotating stall at a region downstream of the vaned portion of the diffuser.

Japanese Patent Unexamined Publication No. 1-125599 discloses an example in which the flow is deflected by the vanes of the diffuser, and also the channel is contracted, and a relatively large deflection of the flow is enabled at the vaned portion of the diffuser without imposing a large load on the vanes. In this known example, a flow angle at an inlet of the vaneless portion, provided downstream of the vaned portion of the diffuser, is large, so that there is achieved an advantage that the flow passage length of the vaneless portion can be reduced. However, the channel height of the whole of the vaneless portion becomes low, and the wetted perimeter area of fluid becomes large. Therefore, the influences of the both cancel each other, and the effect of reducing the friction loss in the vaneless portion can not be sufficiently displayed.

As described above, particularly in the low specific speed centrifugal compressor stage, in addition to the performance represented by the efficiency and the operation range, the prevention of the rotating stall which occurs in the diffuser is important, but in the above conventional techniques, sufficient consideration has not been given to satisfy these at the same time.

It is an object of this invention to provide a centrifugal compressing having a relatively low specific speed centrifugal compressor stage with a specific speed of 80 to 250, in which a rotating stall, occurring in a diffuser, is prevented, and which has a high efficiency, a wide operation range and a high reliability, and also to provide a diffuser used therein.

Another object of this invention is to provide a diffuser for a centrifugal compressor in which the construction of preventing a rotating stall is simple and inexpensive, and also to provide a centrifugal compressor provided with this diffuser.

A further object of this invention is to provide a diffuser for a multi-stage centrifugal compressor in which a rotating stall is prevented, and also to provide a centrifugal compressor provided with this diffuser.

To achieve the above objects, according to one form of the present invention, there is provided a single-stage or a multi-stage centrifugal compressor comprising a rotation shaft, one or a plurality of impellers mounted on the rotation shaft, and a first vaned diffuser provided radially outwardly of at least one of the impellers and having two opposed wall surfaces and a plurality of first vanes disposed between the wall surfaces in a spaced relationship with one another in a circumferential direction, wherein a vaneless diffuser is provided at a downstream side of the vaned diffuser, said vaneless diffuser having two opposed wall surfaces between which axial distance is decreased progressively from an inlet to an outlet.

According to another form of the present invention, there is provided a single-stage or a multistage centrifugal compressor comprising a rotation shaft, one or a plurality of impellers mounted on the rotation shaft, and a vaned diffuser provided radially outwardly of at least one of the impellers and having two opposed wall surfaces and a plurality of first vanes disposed between the wall surfaces in a spaced relationship with one another in a circumferential direction, wherein a second vaned diffuser is provided at a downstream side of the first vaned diffuser, said second vaned diffuser having two opposed wall surfaces between which axial distance is decreased progressively from an inlet to an outlet and a plurality of second vanes disposed between the wall surfaces in a spaced relationship with one another in a circumferential direction.

Preferably, a meridian plane cross-sectional shape of each of the two wall surfaces, forming the vaneless diffuser, comprises a smooth line including a straight line or an arc.

Preferably, an inlet vane angle of the first vanes of the first vaned diffuser, measured in a peripheral direction, is 4° to 12°.

Preferably, an axial height of the outlet of the vaneless diffuser is 0.3 to 0.6 times as large as an axial height of an outlet of the first vaned diffuser.

One of the opposed wall surfaces, forming the vaneless diffuser, may be directed radially in a meridian plane cross-section, while the other wall surface may be inclined to approach the one wall surface progressively in the downstream direction.

A vane height at the outlet of the impeller may be equal to the distance between the two opposed wall surfaces of the first vaned diffuser.

The two opposed wall surfaces, forming the vaneless diffuser, may be both inclined toward that side, corresponding to a core plate of the impeller, progressively in the downstream direction.

Preferably, a specific speed of the impeller is 80 to 250, and more preferably the specific speed of the impeller is 100 to 200.

Preferably, the first vanes of the first vaned diffuser have such a size that a line normal to the first vane at the inlet does not intersect the adjoining first vane.

In order to achieve the above objects, according to a third form, there is provided a single-stage or a multi-stage centrifugal compressor comprising a rotation shaft, one or a plurality of impellers mounted on the rotation shaft, and a first vaned diffuser provided radially outwardly of at least one of the impellers and having two opposed wall surfaces and a plurality of first vanes disposed between the wall surfaces in a spaced relationship with one another in a circumferential direction, wherein rotating stall prevention means for preventing a rotating stall of a fluid, flowing out of the impeller, is provided around an outer periphery of the first vaned diffuser.

In order to achieve the above objects, according to a fourth form, there is provided a diffuser comprising a first vaned diffuser portion provided on an outer periphery of an impeller and a vaneless diffuser portion provided around an outer periphery of the first vaned diffuser portion, the first vaned diffuser portion having two opposed wall surfaces and a plurality of vanes disposed between the wall surfaces in a spaced relationship with one another in a circumferential direction, and the vaneless diffuser portion having two opposed wall surfaces, wherein in a meridian cross-section, the distance between the two wall surfaces, forming the vaneless diffuser portion, is smoothly decreased progressively from an inner side to an outer side.

BEST MODE OF CARRYING OUT THE INVENTION

Figure 1:
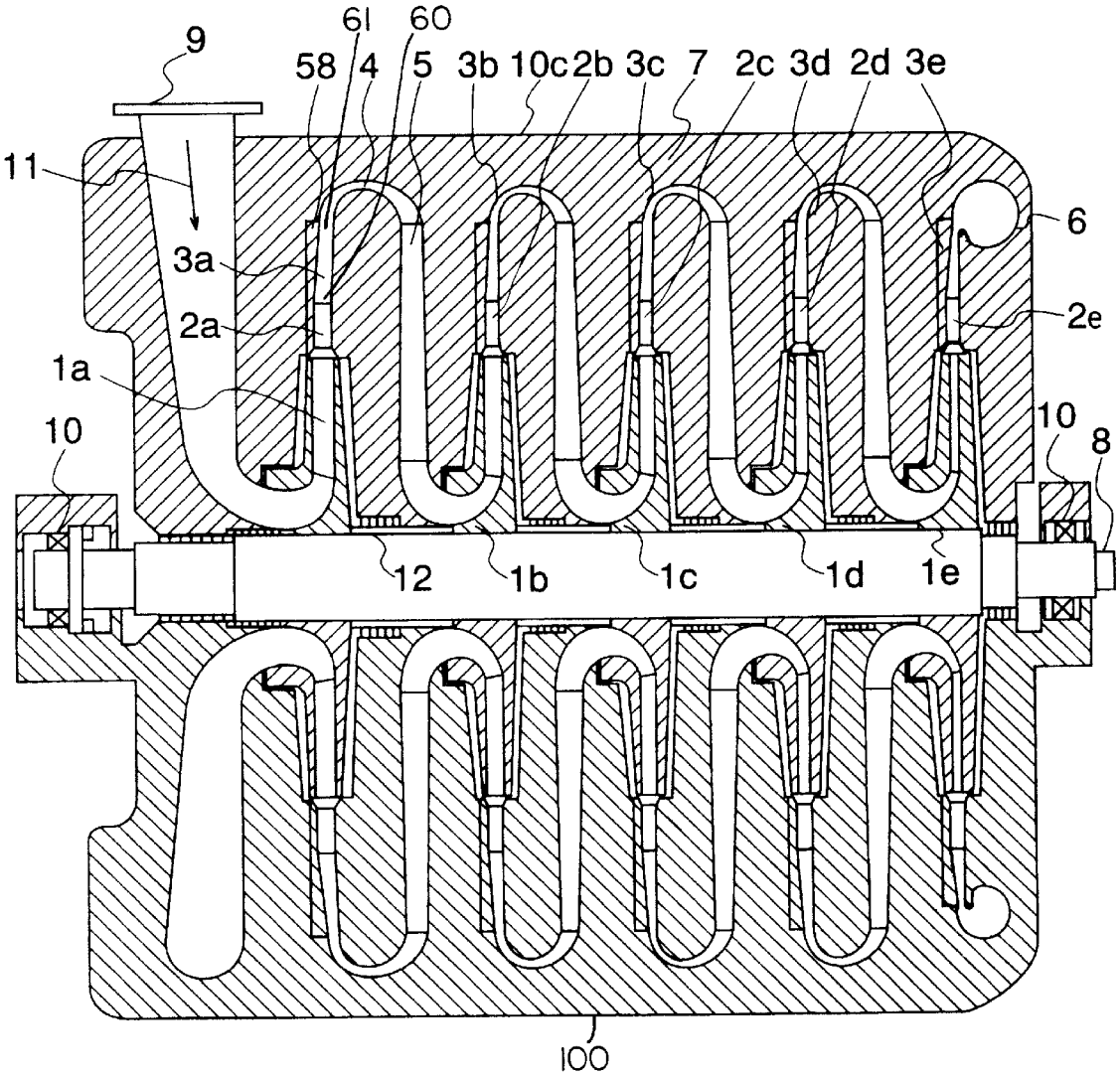
FIG. 1 is a longitudinal cross-sectional view of a multi-stage centrifugal compressor of the present invention.

Several embodiments of the present invention will now be described with reference to the drawings. FIG. 1 is a view showing a longitudinal cross-sectional shape of a multi-stage centrifugal compressor of the present invention. Compressor stages, formed in a multistage manner by a plurality of impellers 1*a* to 1*e* and a plurality of diffusers comprising vaned diffusers 2*a* to 2*e* and vaneless diffusers 3*a* to 3*e*, are stacked together in an axial direction to form a multi-stage centrifugal compressor 100. Namely, the plurality of impellers 1*a* to 1*e* are stacked together in the axial direction on a rotation shaft 8, and opposite end portions of the rotation shaft 8 are rotatably supported by bearings 10, respectively. The vaned diffusers 2*a* to 2*e* are provided radially outwardly of (that is, at downstream sides of) the impellers 1*a* to 1*e*, respectively, and further the vaneless diffusers 3*a* to 3*e* are provided radially outwardly of these vaned diffusers, respectively. The vaneless diffusers 3*a* to 3*d* of all the stages except the last-stage are connected respectively to return bends 4 each of which feeds a working fluid to the next stage, and a return channel 5 for radially inwardly feeding the working fluid is formed at a downstream side of each return bend 4. A scroll 6 for collecting the working fluid flowing out of the last-stage impeller and for discharging it to a discharge pipe (not shown) is formed at a downstream side of the last-stage vaneless diffuser 3*e*. The vaned diffusers 2*a* to 2*e*, the vaneless diffusers 3*a* to 3*e*, the return bends 4, the return channels 5 and the scroll 5 are the stationary members, and are mounted on or formed in a compressor casing 7. An interstage seal portion 12 for preventing the leakage flow is formed between any two adjacent stages of the compressor. Here, the vaneless diffuser of each stage except the last-stage is that portion extending from an outer radial position 60 of vanes of the vaned diffuser to a bend-starting position 61 of the return bend 4, and the vaneless diffuser of the last stage is that portion extending from an outer radial position of the vaned diffuser to an end of a wall surface extending into a scroll casing 6.

The operation of the multi-stage centrifugal compressor thus formed will be now described. The working fluid, drawn through a suction port 9 in the flow direction, is increased in pressure by the 1st-stage impeller la, and is further increased in pressure while passing through the vaned diffuser portion 2*a* and the vaneless diffuser portion 3*a*, and then the direction of flow of the working fluid is changed by the return bend 4 from a radially-outward direction to a radially-inward direction, and then the working fluid is fed to the 2nd-stage impeller via the return channel 5. Subsequently, such a flow is repeated in each stage, so that the working fluid is gradually increased in pressure, and the working fluid, after passed through the last-stage diffuser, passes through the discharge scroll 6, and is fed to a discharge pipe. In this multi-stage centrifugal compressor, the specific speed is lowered gradually from the first stage toward the last stage, and it is not unusual that the specific speed is less than 200 in the vicinity of the last stage.

Figure 2:
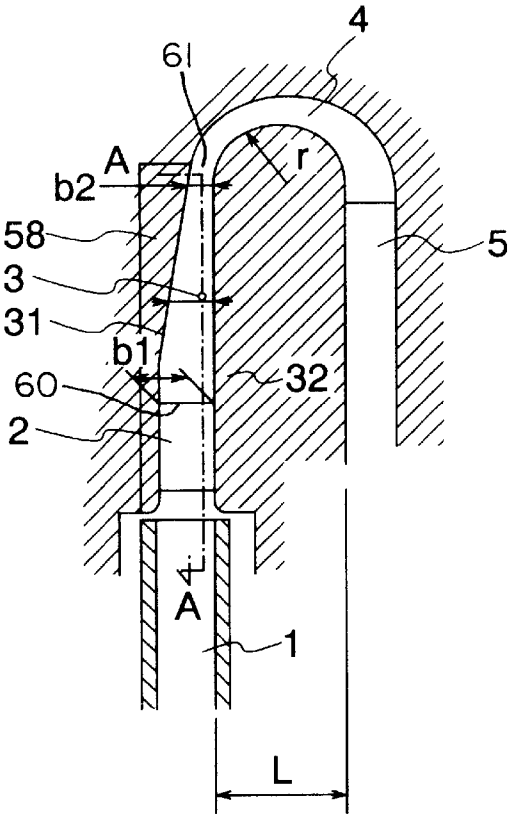
FIG. 2 is a longitudinal cross-sectional view of an intermediate stage of the centrifugal compressor shown in FIG. 1, mainly showing a diffuser portion on an enlarged scale.
Figure 3:
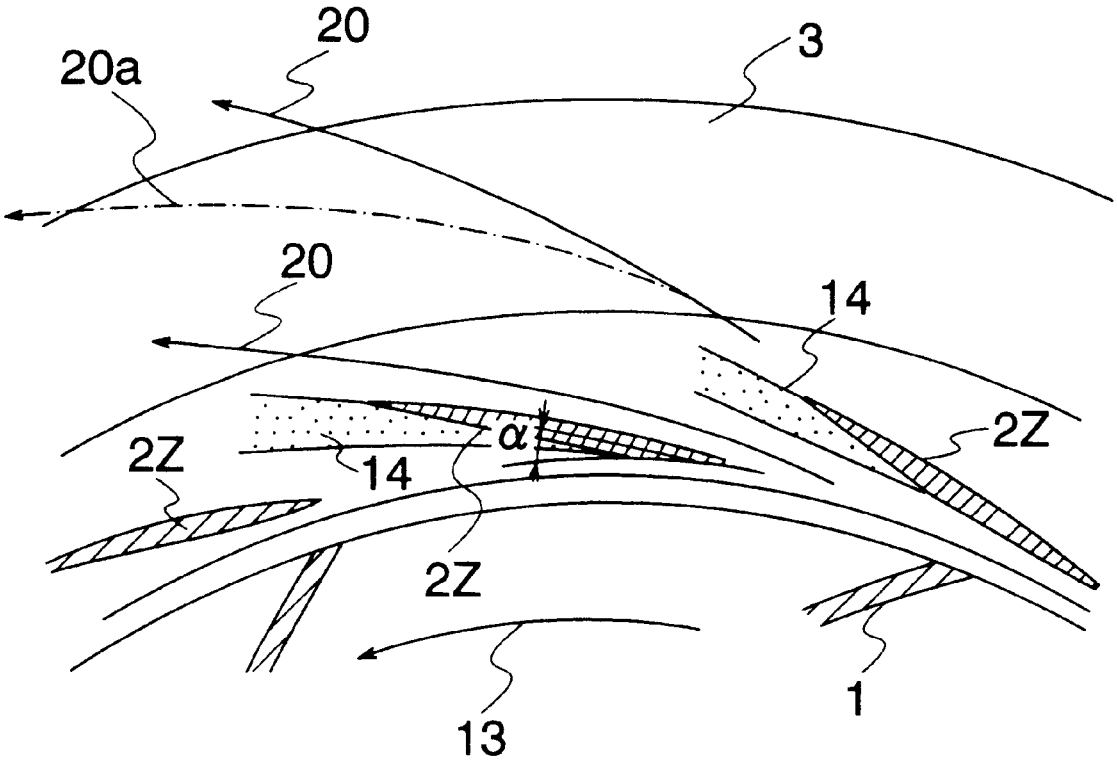
FIG. 3 is a view taken along the line A—A of FIG. 2.

FIG. 2 is a view showing in detail that portion of one stage of the multi-stage compressor of FIG. 1 extending from an outlet portion of the impeller toward the next stage. FIG. 3 is a view as seen in a direction A—A of FIG. 2. An axial passage height b of the vaneless diffuser portion 3 of each stage is radially outwardly decreased progressively or smoothly from the outlet 60 of the vaned diffuser portion 2 (which is the inlet of the vaneless diffuser portion) to the outlet 61 of the vaneless diffuser. One wall surface 58, constituting this vaned diffuser 2 and the vaneless diffuser 3, is formed in an integral manner, and its inner diameter end begins from the outlet portion of the impeller, and its outer diameter end is disposed at a position where the bending of the return bend 4 begins.

In this embodiment, as shown in FIG. 2, the direction of flow of the working fluid, flowing out of the impeller, is turned by the vanes 2*z* of the vaned diffuser having the vane height substantially equal to the height of the blades of the impeller, and this working fluid flows into the vaneless diffuser portion 3. In a compressor stage of a low specific speed (the specific speed is not more than about 200), the performance is enhanced by reducing a discharge angle of an impeller. And, a conventional method of contracting the passage width at the diffuser inlet increases a surging-generating region, and therefore is not desirable, and it is desirable to reduce an angle $\alpha$ of mounting of the vanes of the diffuser to 4° to 12°. If this mounting angle $\alpha$ is increased to a certain degree, the flow angle is increased by deflecting the flow by the vanes 2*z*, so that the rotating stall can be suppressed. However, when the mounting angle $\alpha$ is less than 12° as in this embodiment, the inlet angle of the working fluid into the vaneless portion 3 is not so increased even if the flow is deflected and decelerated by the vanes 2*z*. In the case where this vaneless portion 3 is formed by parallel walls, the flow is that as indicated by a dot5 and-dash line in FIG. 3. As a result, the average flow angle of the working fluid becomes small, and the flow becomes unstable under the influence of wakes 14 of the diffuser vanes 2*z*, so that the rotating stall is liable to occur.

In this embodiment, that wall 31 of the vaneless diffuser portion 3, corresponding to a side plate of the impeller, is inclined toward that side, corresponding to a core plate of the impeller, progressively in the radially-outward direction. In the embodiment shown in FIG. 2, the channel height b of the vaneless diffuser portion 3 is decreased substantially linearly in the radial direction, and by thus progressively decreasing the passage height of the vaneless diffuser portion 3, the flow 20 of FIG. 3 can be realized, and the flow angle is larger as compared with the flow 20*a*. Therefore, the development of a wall surface boundary layer can be suppressed, and the flow can be stabilized, and the rotating stall can be suppressed. In this embodiment, the contraction ratio $b_2/b_1$ is about 0.5. If this contraction ratio $b_2/b_1$ is small, the average flow angle of the working fluid in the vaneless diffuser portion 3 becomes large, and the rotation stall prevention effect is enhanced, and also the reliability against the rotating stall is enhanced. However, if the contraction ratio $b_2/b_1$ is decreased, the passage height downstream of the vaneless diffuser portions 3*a* to 3*e* is also decreased, and the wetted perimeter area is increased, so that the friction loss increases. Therefore, the contraction ratio $b_2/b_1$ is desirably 0.3 to 0.6, and preferably about 0.5.

As described above, it is necessary to provide the seal portion 12 between any two adjacent stages of the multi-stage compressor, and therefore an inner wall width L of the return bend 4 is inevitably more than a predetermined length. Therefore, in the case of the low specific speed stage, the radius r of curvature of the return bend 5 becomes unnecessarily large, and the channel length is increased, so that the friction loss increases. In this embodiment, the wall 31 of the diffuser close to the preceding stage (i.e., at that side corresponding to the side plate of the impeller) is inclined, and the channel height of the vaneless portion is decreased progressively in the downstream direction. With this construction, the radius r of curvature of the inner wall of the return bend 5 can be made smaller as compared with the case where that wall 32, corresponding to the core plate of the impeller, is inclined, and the friction loss in the return bend 5 can be reduced.

Figure 4:
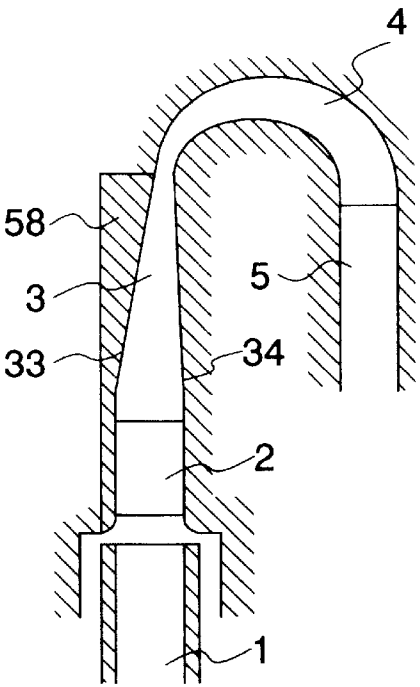

FIG. 4 is a longitudinal cross-sectional view of another embodiment of a diffuser of the present invention, and corresponds to FIG. 2. This embodiment differs from the embodiment of FIG. 2 in that that wall surface 34 of a vaneless diffuser portion 3, corresponding to a core plate of an impeller, is inclined toward that side corresponding to a side plate of the impeller. In this embodiment, the two wall surfaces 33 and 34 of the vaneless diffuser portion are formed linearly in an inclined manner, and a passage height is decreased progressively in a downstream direction, so that a channel is contracted generally in the same degree from the opposite wall surfaces, and therefore the two wall surfaces have generally the same degree of development of a boundary layer, and a flow distribution in the direction of the passage height can be made more uniform, and the recovery of the static pressure in the vaneless diffuser portion 3 can be enhanced.

Figure 5:
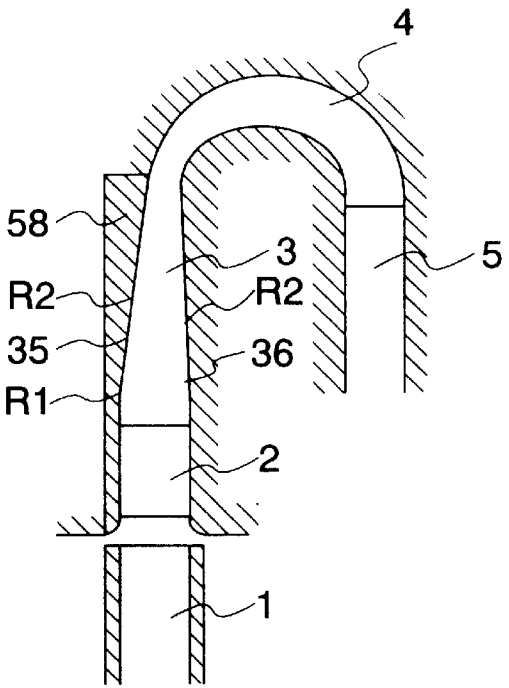
FIGS. 4 to 8 are longitudinal cross-sectional views showing other embodiments of the present invention, respectively, mainly showing a diffuser portion on an enlarged scale.

FIG. 5 shows a modified example of the embodiment shown in FIG. 4, and that portion of each of two walls 35 and 36 of a vaneless diffuser portion 3 close to a vaned diffuser is formed by a curved surface having a radius R1 of curvature while that portion of each of the two walls close to a return bend is formed by a curved surface having a radius R2 of curvature, and the two walls have substantially the same configuration, and a channel height is contracted progressively in a downstream direction. In this modified example, a channel is smoothly contracted, and therefore the flow in the diffuser can be made more smooth, so that there can be achieved the effect of further reducing a flow loss in the vaneless diffuser.

Figure 6:
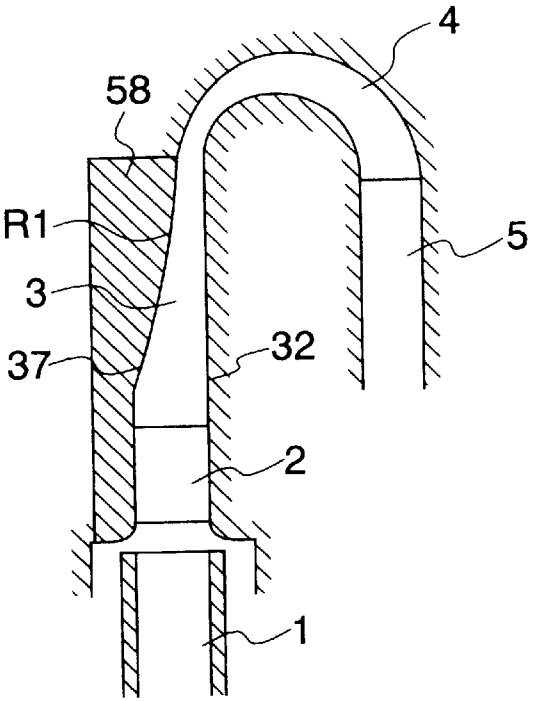

FIG. 6 shows a modified example of the embodiment shown in FIG. 2, and that wall surface 37 of a vaneless diffuser 3, corresponding to a side plate of an impeller, is formed by an arc having a radius R1 of curvature, and a passage of the vaneless diffuser 3 is contracted progressively in a downstream direction. In this modified example, as compared with the embodiment of FIG. 2, there are disadvantages that the machining is a little more cumbersome and that a wetted perimeter area is increased. However, the contraction rate of a front half of the channel of the vaneless diffuser portion 3 is increased so as to increase a meridian plane speed in the front half of the vaneless diffuser portion 3 so that the flow angle of the vaneless diffuser portion 3 can be increased early, and therefore there is achieved a marked effect of preventing a rotating stall. Namely, this modified example is suitable when priority is given to the rotating stall prevention over the performance. In this modified example, although that wall surface of the vaneless diffuser, corresponding to the side plate of the impeller, is formed into the smooth surface by one arc, this wall surface may be formed into a curved surface by connecting a plurality of arcs together, or may be formed into a smooth curved surface by a combination of an arc and a straight line. With this arrangement, the more smooth wall surface can be easily formed by a NC machining tool or the like.

Figure 7:
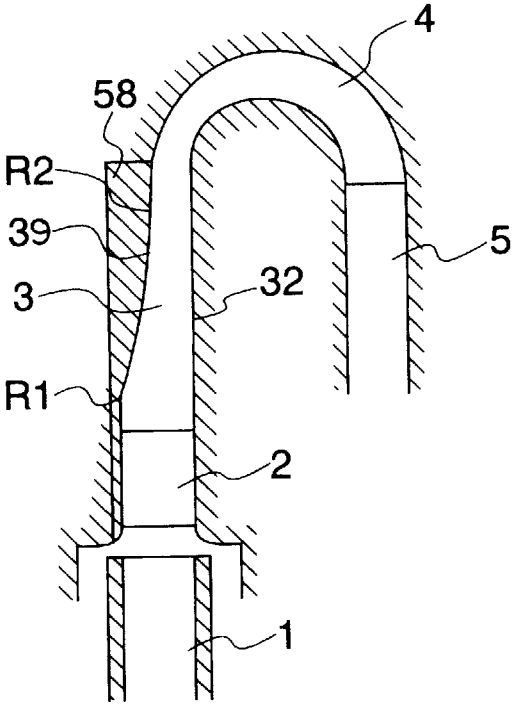

FIG. 7 is another modified example of the embodiment of FIG. 2, and that wall 39 of a vaneless diffuser 3 close to a vaned diffuser 2 is formed into a curved surface by connecting two arcs R1 and R2 together. In this modified example, effects, similar to the effects achieved by the embodiment of FIG. 2, are obtained, and also the machining of the diffuser is a little more cumbersome as compared with the embodiment of FIG. 2, but there is achieved the effect of reducing a flow loss in the vaneless diffuser portion 3 as compared with the embodiment of FIG. 2.

Figure 8:
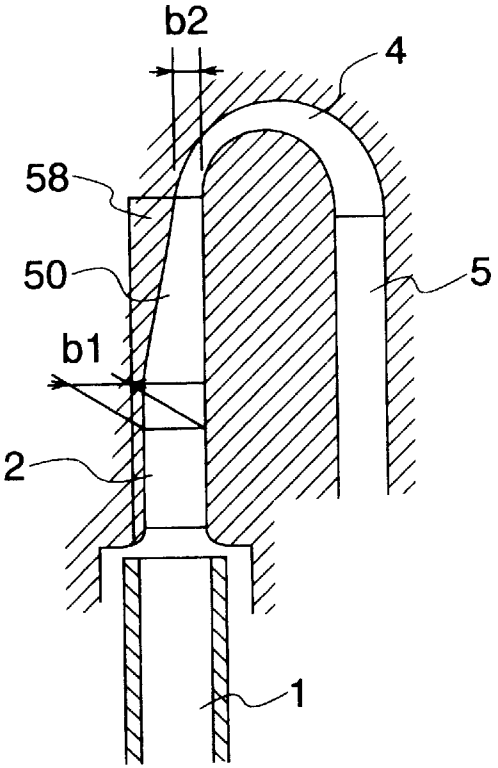
Figure 9:
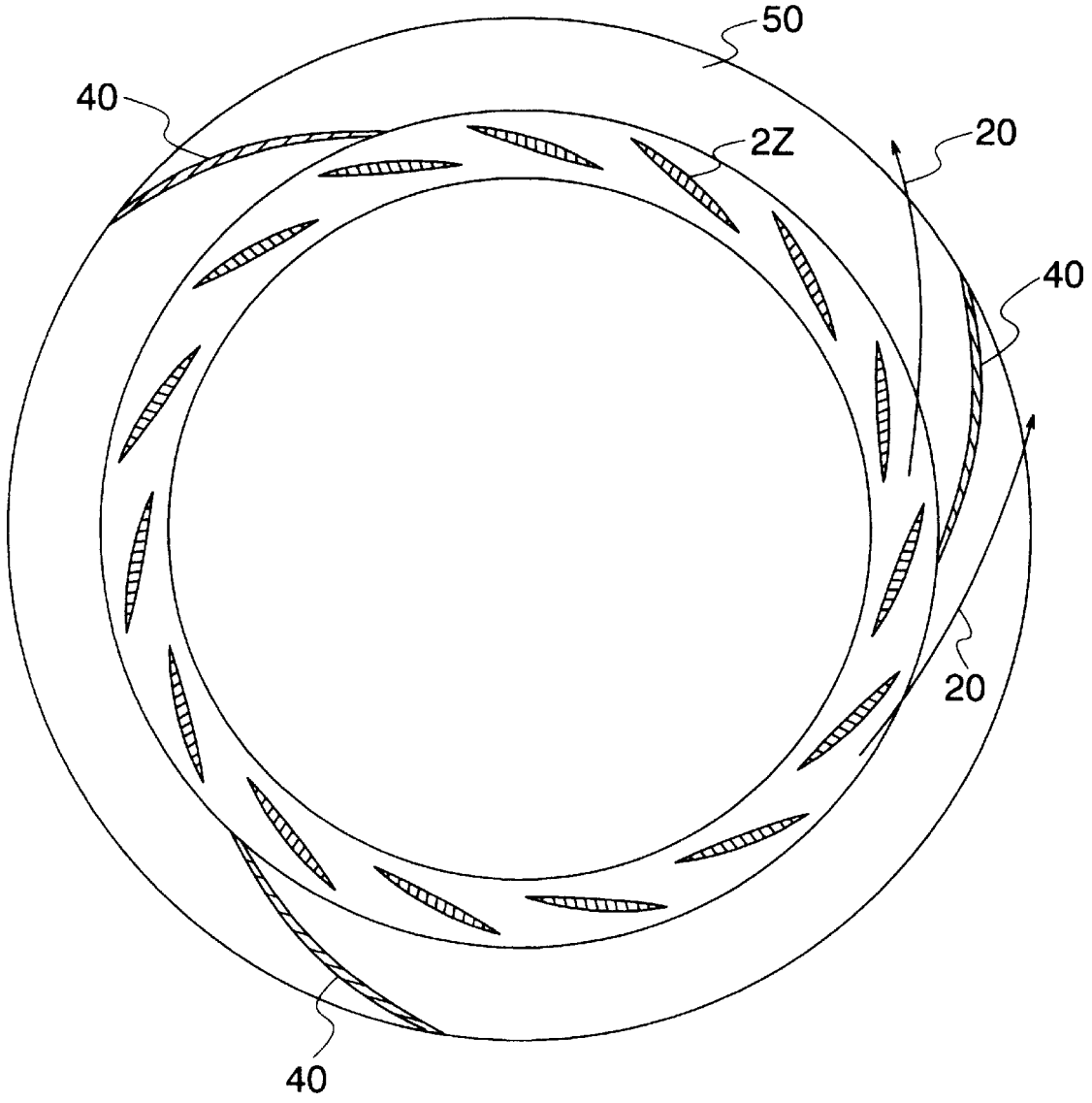
FIG. 9 is a front elevational view of one embodiment of a vaned diffuser of the present invention.

FIG. 8 is a longitudinal cross-sectional view of a further embodiment of the present invention, and FIG. 9 is a transverse cross-sectional view thereof. Instead of a vaneless diffuser, a second vaned diffuser 50, having three rotation prevention guide plates 40, is provided downstream of a vaned diffuser 2, and a passage height of this second vaned diffuser 50 is contracted progressively in a downstream direction.

In a vaneless diffuser, when a reverse flow of a boundary layer develops locally, this triggers occuring of stall cell, and this stall cell revolves in the diffuser, so that a rotating stall occurs. In this embodiment, even when a small reverse flow develops in the second vaned diffuser portion provided instead of the conventional vaneless diffuser, the rotation prevention guide plates stop the rotation, and therefore the development into a large-scale stall cell can be prevented. For this reason, it is preferred that several rotation prevention plates 40 be provided, and in this embodiment, the number of these plates is 3. With this construction, the rotating stall can be prevented more positively, and there can be provided a compressor of a higher reliability. In the case where the rotation prevention plates 40 are provided, the contraction ratio $b_2/b_1$ of the second vaned diffuser portion 40 can be made larger than 0.3 to 0.6.

Figure 11:
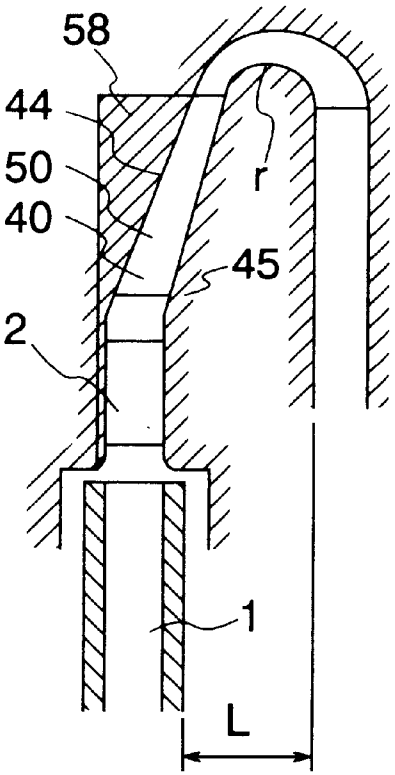
FIGS. 10 and 11 are longitudinal cross-sectional views of further embodiments of the present invention, respectively, mainly showing a diffuser portion on an enlarged scale.
Figure 10:
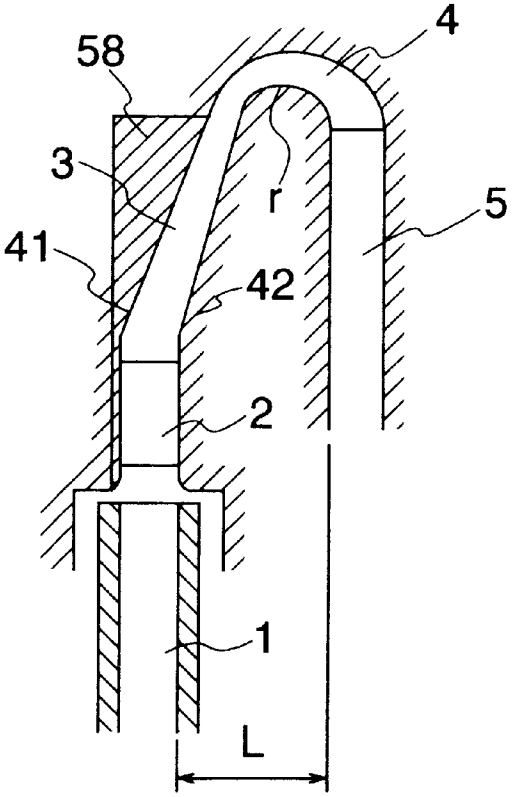

FIGS. 10 and 11 show further embodiments of diffusers of the present invention, respectively, and two wall surfaces 41 and 42, forming a vaneless diffuser portion 3, as well as two wall surfaces 44 and 45, forming a second vaned diffuser 50, are inclined toward that side corresponding to a core plate of an impeller. In addition, a channel height of each of the vaneless diffuser portion 3 and the second vaned diffuser portion 50 is contracted progressively in a downstream direction. With this construction, while securing an axial length L necessary for mounting an interstage seal 12, a radius r of curvature of an inner wall of a return bend 4 can be reduced.

The vaned diffuser 2 and the vaneless diffuser 3 decelerate the flow, but the radius of an inlet of the return bend 5 is not different from the radius of an outlet thereof. Therefore, in a low specific speed stage of a compressor in which a peripheral component is large, the flow is not so decelerated, and the larger the channel length is, the larger a friction loss is. Therefore, by reducing the radius of curvature of the inner wall of the return bend as in this embodiment, there can be obtained the effect of reducing the friction loss in the return bend portion.

Figure 12:
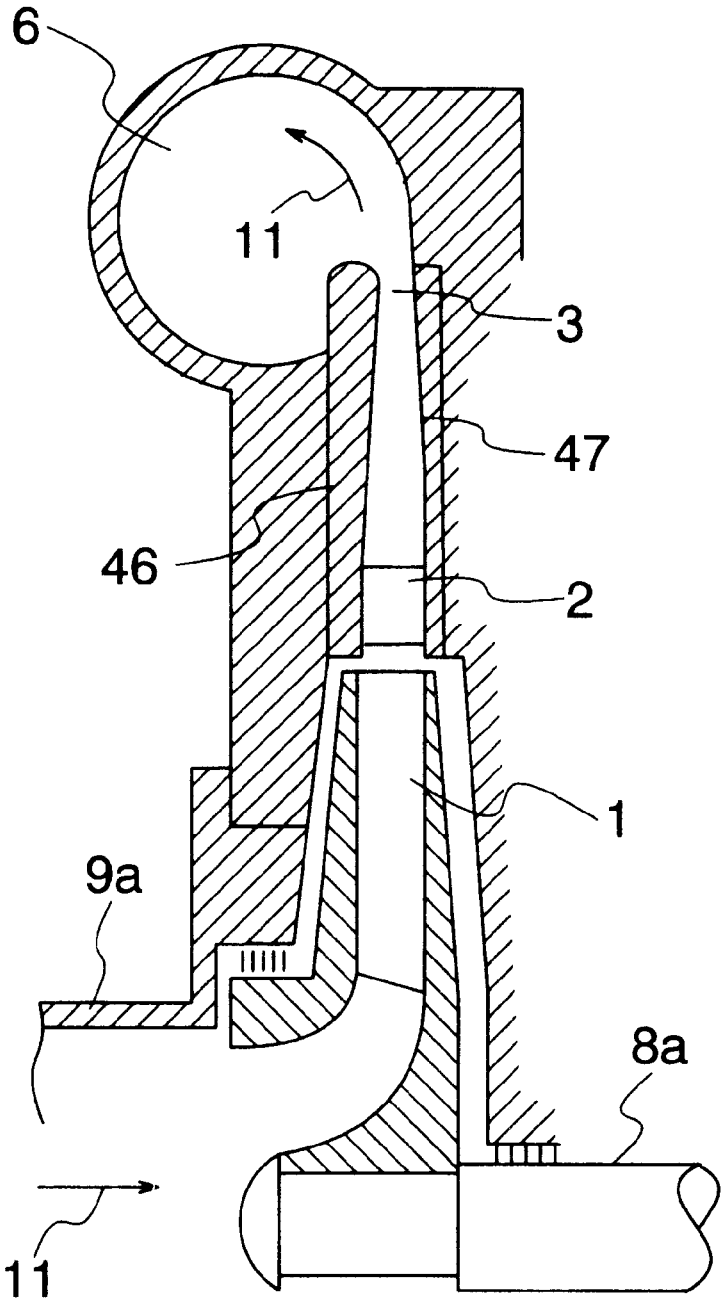
FIG. 12 is a longitudinal cross-sectional view of one embodiment of a single-stage centrifugal compressor of the present invention.

FIG. 12 shows a single-stage centrifugal compressor, and an impeller 1 is mounted on a rotation shaft 8*a*, and the flow passes through the impeller 1, a vaned diffuser portion 2 and a vaneless diffuser portion 3, and is discharged from a scroll casing 6. Here, the vaneless diffuser portion 3 is that portion extending from an outer radial position of vanes of the vaned diffuser portion 2 to an end of a wall surface 46 extending into a scroll casing 6. In this embodiment, the wall surface 46 (one of the two wall surfaces forming the vaneless diffuser portion 3), corresponding to a side plate of the impeller, is inclined radially outwardly, and that wall surface 47, corresponding to a core plate of the impeller, is inclined toward the wall surface 46. With this construction, the flow is contracted progressively in a downstream direction. The scroll 6 is formed downstream of the diffuser portion, and collects the working fluid, discharged from the impeller 1, and feeds it to a discharge pipe (not shown). The vaneless diffuser portion is contracted, and with this arrangement, the outlet casing can be freely chosen without affecting the fluid performance and the rotating stall-suppressing effect. In this embodiment, there is achieved the effect of preventing the rotating stall regardless of the specific speed of the impeller, but this effect is marked when the specific speed is small and particularly not more than 200. Further, in any of the above embodiments, the vaned diffuser is not limited to a vaned-shape, but any type of diffuser can be used. However, its effect is conspicuous in the low solidity vaned diffuser. Here, the term "low solidity vaned diffuser" means one in which its vanes are so short that a line perpendicular to an inlet angle of the diffuser vane does not intersect the adjoining vane, and a value, obtained by dividing the average value of the pitch of the diffuser vane inlets and the pitch of the diffuser vane outlets by the chord length of the diffuser vane, is not more than about 1.

As described above, in the present invention, in the low specific speed stage (the specific speed is 80 to 250, and preferably 100 to 200) of the multi-stage centrifugal compressor, the two wall surfaces, forming the vaneless diffuser portion or the second vaned diffuser portion provided downstream of the vaned diffuser, are contracted progressively in the downstream direction, and with this construction there is achieved the effect of preventing the rotating stall. In the low specific speed stage (the specific speed is 80 to 250, and preferably 100 to 200) of the single-stage centrifugal compressor, the vaneless diffuser portion, provided downstream of the vaned diffuser, is contracted progressively in the downstream direction, and with this construction, there can be obtained the compressor in which the rotating stall is prevented, and the operation range is wide.

The preferred embodiments described in this invention have been given by way of examples, and do not mean the limitations, and the scope of the invention is indicated in the appended claims, and any modifications, falling within the scope of these claims, are included in the present invention.

What is claimed is:

1. A multi-stage centrifugal compressor comprising a rotation shaft, a plurality of impellers mounted on said rotation shaft, and a first vaned diffuser provided radially outwardly of at least one stage of said impellers and having two opposed wall surfaces and a plurality of first vanes disposed between said wall surfaces in a spaced relationship with one another in a circumferential direction;

Characterized in that a vaneless diffuser is provided at a downstream side of said first vaned diffuser, said vaneless diffuser having two opposed wall surfaces between which axial distance is decreased progressively from an inlet to an outlet.

2. A centrifugal compressor according to claim 1, in which a meridian plane cross-sectional shape of each of said two wall surfaces, forming said vaneless diffuser, comprises a straight line.

3. A centrifugal compressor according to claim 1, in which a meridian plane cross-sectional shape of at least one of said two wall surfaces, forming said vaneless diffuser, includes an arc.

4. A centrifugal compressor according to claim 1, in which an inlet vane angle of said first vanes of said first vaned diffuser, measured in a peripheral direction of said first vanes of said first vaned diffuser, is 4° to 12°.

5. A centrifugal compressor according to claim 1 or claim 4, in which an axial height of the outlet of said vaneless diffuser is 0.3 to 0.6 times as large as an axial height of an outlet of said first vaned diffuser.

6. A centrifugal compressor according to claim 5, in which one of said opposed wall surfaces, forming said vaneless diffuser, is directed radially in a meridian plane cross-section, and the other wall surface is inclined to approach said one wall surface progressively in the downstream direction.

7. A centrifugal compressor according to claim 1 or claim 6, in which a blade height at an outlet of said impeller is equal to the distance between said two opposed wall surfaces of said first vaned diffuser.

8. A centrifugal compressor according to claim 1, in which said two opposed wall surfaces, forming said vaneless diffuser, are both inclined toward a side corresponding to a core plate of said impeller progressively in the downstream direction.

9. A centrifugal compressor according to claim 1 or claim 6, in which a specific speed of said impeller is 80 to 250.

10. A centrifugal compressor according to claim 1 or claim 6, in which a specific speed of said impeller is 100 to 200.

11. A centrifugal compressor according to claim 1 or claim 2, in which said first vanes of said first vaned diffuser have such a size that a line normal to said first vane does not intersect the adjoining first vane.

12. A multi-stage centrifugal compressor comprising a rotation shaft, a plurality of impellers mounted on said rotation shaft, and a first vaned diffuser provided radially outwardly of at least one stage of said impellers and having two opposed wall surfaces and a plurality of first vanes disposed between said wall surfaces in a spaced relationship with one another in a circumferential direction;

Characterized in that a second vaned diffuser is provided at a downstream side of said first vaned diffuser, said second vaned diffuser having two opposed wall surfaces and a plurality of second vanes disposed between said wall surfaces in a spaced relationship with one another in the circumferential direction, and an axial distance between said two opposed wall surfaces of said second vaned diffuser being decreased progressively from an inlet to an outlet.

13. A centrifugal compressor comprising a rotation shaft, an impeller mounted on said rotation shaft, and a vaned diffuser provided radially outwardly of said impeller and having two opposed wall surfaces and a plurality of vanes disposed between said wall surfaces in a spaced relationship with one another in a circumferential direction;

Characterized in that a vaneless diffuser is provided at a downstream side of said vaned diffuser, said vaneless diffuser having two opposed wall surfaces between which axial distance is smoothly decreased progressively from an inlet to an outlet.

14. A centrifugal compressor according to claim 13, in which a specific speed of said impeller is in the range of from 80 to 250.

15. A centrifugal compressor according to claim 13, in which the vanes of said vaned diffuser have such a size that a line normal to said vane does not intersect the adjoining vane.

16. A diffuser comprising a vaned diffuser portion provided on an outer periphery of an impeller, and a vaneless diffuser portion provided around an outer periphery of said vaned diffuser, said vaned diffuser portion having two opposed wall surfaces and a plurality of vanes disposed between said wall surfaces in a spaced relationship with one another in a circumferential direction, and said vaneless diffuser having two opposed wall surfaces;

Characterized in that in a meridian cross-section, the distance between said two wall surfaces, forming said vaneless diffuser, is decreased progressively from an inner end to an outer end.

* * * * *